US011001951B2

(12) United States Patent
Zheng

(10) Patent No.: US 11,001,951 B2
(45) Date of Patent: May 11, 2021

(54) PRESSURE ADJUSTMENT MECHANISM OF SEWING MACHINE PRESSER FOOT

(71) Applicant: Sigma Mattress Machinery (Zhejiang) Co., Ltd., Taizhou (CN)

(72) Inventor: Xi Zheng, Taizhou (CN)

(73) Assignee: Sigma Mattress Machinery (Zhejiang) Co., Ltd., Taizhou (CN)

( * ) Notice: Subject to any disclaimer, the term of this patent is extended or adjusted under 35 U.S.C. 154(b) by 375 days.

(21) Appl. No.: 15/997,747

(22) Filed: Jun. 5, 2018

(65) Prior Publication Data

US 2019/0309459 A1 Oct. 10, 2019

(30) Foreign Application Priority Data

Apr. 9, 2018 (CN) ..... 201810312116.7

(51) Int. Cl.
*D05B 29/02* (2006.01)
*D05B 29/08* (2006.01)

(52) U.S. Cl.
CPC ..... *D05B 29/02* (2013.01); *D05B 29/08* (2013.01)

(58) Field of Classification Search
CPC ..... D05B 29/02; D05B 29/08; D05B 29/00; D05B 29/04; D05B 29/06
See application file for complete search history.

(56) References Cited

U.S. PATENT DOCUMENTS

| | | | | |
|---|---|---|---|---|
| 4,301,757 | A * | 11/1981 | Tonomura | B65H 75/182 112/254 |
| 4,630,557 | A * | 12/1986 | Russell | D05B 29/02 112/235 |
| 4,716,846 | A | 1/1988 | Schneider et al. | |
| 5,309,854 | A * | 5/1994 | Mulcahey | D05B 27/04 112/313 |
| 5,317,981 | A * | 6/1994 | Hashiride | D05B 29/10 112/102.5 |
| 5,551,361 | A | 9/1996 | Clapp et al. | |
| 5,855,177 | A | 1/1999 | Nakayama et al. | |
| 6,415,725 | B1 | 7/2002 | Yoshikazu | |
| 6,564,732 | B1 | 5/2003 | Hosagasi et al. | |
| 2018/0016722 | A1 | 1/2018 | Ueda et al. | |

FOREIGN PATENT DOCUMENTS

| | | | |
|---|---|---|---|
| CN | 1218077 | C | 9/2005 |
| CN | 202482603 | U | 10/2012 |
| CN | 203238427 | U | 10/2013 |

(Continued)

*Primary Examiner* — Nathan E Durham
(74) *Attorney, Agent, or Firm* — Minder Law Group; Willy H. Wong

(57) ABSTRACT

A pressure adjustment mechanism of the sewing machine presser foot comprises a motor, a screw actuated by the motor, a spiral spring and a pressing plate for pressing against an upper end of the presser foot. A nut is screwed and connected on the screw, and the nut is lifted or lowered by the screw. The pressing plate is underneath the nut. The circumferential direction of the nut is unfixed. The spiral spring is located between the nut and the pressing plate, an upper end of the spiral spring is pressed against the nut, and a lower end of the spiral spring is pressed against the pressing plate. The spiral spring is being compressed under the effects of the nut and the pressing plate.

10 Claims, 4 Drawing Sheets

(56) References Cited

FOREIGN PATENT DOCUMENTS

| | | | |
|---|---|---|---|
| CN | 104131420 | A | 11/2014 |
| CN | 104894758 | A | 9/2015 |
| CN | 204662015 | U | 9/2015 |
| CN | 205669100 | U | 11/2016 |
| CN | 106757826 | A | 5/2017 |
| CN | 107354601 | A | 11/2017 |
| CN | 206814979 | U | 12/2017 |
| CN | 206828769 | U | 1/2018 |
| CN | 206843733 | U | 1/2018 |
| JP | 2658611 | | 9/1997 |
| JP | 3316022 | B2 | 8/2002 |
| JP | 2014068722 | A | 4/2014 |
| JP | 2017192474 | A | 10/2017 |

* cited by examiner

PRESSURE ADJUSTMENT MECHANISM OF SEWING MACHINE PRESSER FOOT

RELATED APPLICATIONS

This application claims priority to China Patent Application No. CN201810312116.7 filed Apr. 9, 2018.

The applications and all patents, patent applications, articles, books, specifications, other publications, documents, and things referenced herein are hereby incorporated herein in their entirety for all purposes. To the extent of any inconsistency or conflict in the definition or use of a term between any of the incorporated publications, documents, or things and the text of the present document, the definition or use of the term in the present document shall prevail.

BACKGROUND OF THE INVENTION

Field of Invention

The present invention relates generally to the technical field of sewing machines, and more particularly relates to a pressure adjustment mechanism of a sewing machine presser foot.

Related Art

A presser foot device is disposed at the machine head of all sewing machines. In the process of fabric sewing, a fabric is pressed down by a presser foot. There are various ways for controlling the presser foot of a sewing machine to lift up or lower down, including electrical, knee-lifting and manual operation. The pressure of the presser foot applied on the fabric is achieved by a spring. However, different fabrics have different thicknesses, and fabrics with different thicknesses cause the presser foot to lower down to different heights. Therefore, different degrees of pressure are applied on fabrics with different thicknesses by the presser foot. Thus, the pressure needs adjustment.

Currently, the ways for adjusting the pressure of the presser foot include manual operation and electrical. The electrical way is achieved by using an actuator to change the degree of compression of the spring so as to adjust the pressure of the spring applied on the presser foot. For example, one prior art discloses an operating apparatus for sewing machine. It comprises a linear motor used as an actuating element for a fabric pressing device. The driving lever for controlling the fabric pressing force applied to a sewing fabric by a fabric pressing device is connected to the fabric pressing device. Wherein, the actuating rod is connected to the fabric pressing device by at least one elastic and low-mass connecting element. Through the linear motor, the fabric pressing device can move between a lifting-position and a lowering-position. In other words, the linear motor is directly used for compressing the spring in order to adjust the pressure of the presser foot. Another prior art discloses a presser foot device. A motor actuates a rack to move via a gear, the rack actuates a nut to turn, and the nut actuates a screw to lift up or lower down. The lifting-up and lowering-down of the screw can adjust the degree of compression of a spring and thus the pressure of the presser foot can be adjusted. In order for the screw and the nut to actuate in coordination, one of them is required to turn and the other one is required to move. The moving element needs to be circumferentially oriented to prevent it from rotating with the turning element. In this prior art, a chute is disposed on the screw, and a sliding block is insertedly connected in the chute to prevent the screw from turning. However, the two presser foot devices mentioned above have a comparatively large defect. In one prior art, the actuating rod of the linear motor is unable to lower down any further when it has compressed the spring downward to the utmost. At this point, the linear motor is overloaded. In one prior art, the screw is unable to lower down any further when it has lowered downward and compressed the spring to the utmost. At this point, the nut gets stuck and causes the motor overload, and thus the linear motor can be burn out easily.

SUMMARY OF THE INVENTION

In view of the above-mentioned problems of the prior art, one object of the present invention is to provide a pressure adjustment mechanism of a sewing machine presser foot to tackle the problem that the motor is easily overloaded and damaged.

One object of the present invention can be achieved technically by the following: a pressure adjustment mechanism of a sewing machine presser foot comprises a motor, a screw actuated by the motor, a spiral spring and a pressing plate for pressing against an upper end of a presser foot; a nut is screwed and connected on the screw, the nut is lifted or lowered by the screw; and the pressing plate is underneath the nut, characterized in that: the circumferential direction of the nut is unfixed; the spiral spring is located between the nut and the pressing plate, an upper end of the spiral spring is pressed against the nut, a lower end of the spiral spring is pressed against the pressing plate, and the spiral spring is being compressed under the effects of the nut and the pressing plate.

After the pressure adjustment mechanism is assembled on a sewing machine, the pressing plate is pressed against the upper end of the presser foot downwardly so that the spiral spring is compressed between the nut and the pressing plate. The pressing plate generates a downward pressure against the presser foot. Thereby, between the upper end of the spiral spring and the nut, between the lower end of the spiral spring and the pressing plate, and between the pressing plate and the presser foot, there is pressure. When the motor actuates the screw to turn, the nut under the effect of the spiral spring is subject to static friction in the circumferential direction. The static friction in the circumferential direction can circumferentially limit the nut and prevent the nut from turning together with the screw. Thereby, the nut is lifted up or lowered down in order to adjust the pressure of the presser foot. Unlike the prior methods, one embodiment of the present invention does not require the coordination of the chute and the sliding block to fix the circumferential direction of the nut. But instead, the nut is limited by the static friction in the circumferential direction. When the nut is lowered overly, and the spiral spring is compressed to the utmost and causes the nut not being able to lower down any further, because, in the circumferential direction, the nut is unfixed, the nut can overcome the static friction in the circumferential direction it is subject to, and turns relative to the spiral spring; or the nut actuates the spiral spring to turn together relative to the pressing plate; or the nut actuates both the spiral spring and the pressing plate to turn together relative to the presser foot. Thereby, the nut is prevented from being unable to lower, getting the screw stuck, and causing the motor to be overloaded and damaged.

In one embodiment of the above-mentioned pressure adjustment mechanism of the sewing machine presser foot, the lower end of the spiral spring is pressed against an upper side of the pressing plate, and, in the circumferential direction, the lower end of the spiral spring and the pressing plate are unfixed. Because the lower end of the spiral spring is merely pressed against the pressing plate, and they are not fixedly connected; the nut and the spiral spring are not fixed in the circumferential direction. Therefore, when the nut is unable to lower down any further, the nut actuates the spiral spring to turn together, and skid relative to the pressing plate. Thereby, the screw is prevented from getting stuck, which causes overload and damage to the motor.

In one embodiment of the above-mentioned pressure adjustment mechanism of the sewing machine presser foot, a lower side of the pressing plate has an inserting column for sleevely connecting with the upper end of the presser foot, the upper side of the pressing plate has a limiting column, and the lower end of the spiral spring is sleeved around the limiting column. Because the pressing plate is merely pressed against the upper end of the presser foot, and they are not fixedly connected; the nut, the spiral spring and the pressing plate are not fixed in the circumferential direction. Therefore, when the nut is unable to lower down any further, the nut actuates the spiral spring and the pressing plate to turn together, and skid relative to the presser foot. Thereby, the screw is prevented from getting stuck, which causes overload and damage to the motor. Wherein, the inserting column is able to keep the pressing plate stable, and the limiting column on the pressing plate is able to keep the lower end of the unfixed spiral spring stable, avoiding a displacement after allowing the relative rotation and slippage among the spiral spring, the pressing plate and the upper end of the presser foot.

In one embodiment of the above-mentioned pressure adjustment mechanism of the sewing machine presser foot, the upper end of the spiral spring is fixedly connected to a metal pad, and a center hole is disposed on the pad. The screw goes through the center hole of the pad. An upper side of the pad is pressed against a lower side of the nut. When the pad and the nut are not fixed in the circumferential direction, the nut is unable to lower down, and turns relative to the pad. Thereby, the motor is protected.

In one embodiment of the above-mentioned pressure adjustment mechanism of the sewing machine presser foot, the nut is made of plastic. The lower side of the nut has a columnar limiting portion, the limiting portion is inserted into the center hole of the pad, and a limiting structure is disposed between the limiting portion and the pad to prevent the nut from turning in the circumferential direction relative to the pad. The friction and noise between the plastic nut and the screw are comparatively smaller, and the cost is comparatively lower. However, the friction between the nut and the pad becomes smaller also. Therefore, the limiting portion is disposed on the nut, and the limiting portion and the pad are fixed in the circumferential direction through the limiting structure. Thereby, the nut is prevented from skidding relative to the pad during the process of adjusting the pressure of the presser foot. When the nut is unable to lower down any further, the nut actuates the pad and the spiral spring to turn together in the circumferential direction through the limiting portion in order to protect the motor.

In one embodiment of the above-mentioned pressure adjustment mechanism of the sewing machine presser foot, the limiting structure comprises a plurality of limiting protruded portions disposing on a hole wall of the center hole. A plurality of axially disposed limiting grooves is disposed on an outer wall of the limiting portion. The limiting protruded portions are engagedly connected in the limiting grooves respectively. The mating structures of the limiting protruded portions and the limiting grooves enable the limiting portion and the pad to be limited in the circumferential direction, and achieve the inserting connection between the limiting portion and the pad, so that the assembly is simpler.

In one embodiment of the above-mentioned pressure adjustment mechanism of the sewing machine presser foot, the sum of the lengths of the limiting portion and the limiting column is larger than that of the spiral spring when it is compressed to the utmost. When the limiting portion and the limiting column are pressed against each other, the nut is unable to lower down any further, and the nut turns and skids in the circumferential direction. At this point, the spiral spring is not fully compressed to the utmost. In other words, the limiting portion and the limiting column pressing against each other can protect and prevent the spiral spring from being damaged.

In one embodiment of the above-mentioned pressure adjustment mechanism of the sewing machine presser foot, a shaft outer wall of the motor has an outer thread to form the screw, and a screw hole of the nut penetrates to a lower end face of the limiting portion. The screw is processed and formed directly from the motor shaft, and thus it is more stable. Additionally, the nut has a screw hole that is comparatively longer, and thus the mating between the nut and the screw is more stable.

In one embodiment of the above-mentioned pressure adjustment mechanism of the sewing machine presser foot, the pressure adjustment mechanism further comprises a sleeve. The nut, the spiral spring and the pressing plate are disposed inside the sleeve. The motor is fixedly connected on an upper end of the sleeve. A lower end of the sleeve is fixedly connected with a cover plate, a through hole is disposed on the cover plate for the upper end of the presser foot to go through, and the pressing plate and the through hole are oppositely disposed. The sleeve is used for accommodating and protecting the parts including the nut, the spiral spring and the pressing plate. The motor and the cover plate are fixed at the two ends of the sleeve respectively to form an integrated module, which makes the assembly more convenient.

In one embodiment of the above-mentioned pressure adjustment mechanism of the sewing machine presser foot, a gap is disposed between an inner circumferential wall of the sleeve and the nut, the pad and the pressing plate. The nut, the pad and the pressing plate are not interfered in the circumferential direction by the sleeve. Thereby, the resistance is reduced when the nut, the pad and the pressing plate turn and skid in the circumferential direction.

In comparison with the prior arts, one embodiment of the pressure adjustment mechanism of the sewing machine presser foot has the following advantages:

1. Because the circumferential direction of the nut is unfixed, when the nut is lowered overly, and if the spiral spring is compressed to the utmost, or if the limiting portion and the limiting column are pressed against each other causing the nut not being able to lower down any further; the nut actuates the spiral spring to turn together relative to the pressing plate; or the nut actuates both the spiral spring and the pressing plate to turn together relative to the presser foot. Thereby, the nut is prevented from being unable to lower, getting the screw stuck, and causing the motor to be overloaded and damaged.

2. The limiting portion and the pad are fixed in the circumferential direction because of the limiting structure. Thereby, the plastic nut is prevented from skidding relative to the pad during the process of adjusting the pressure of the presser foot.

3. Because the sum of the lengths of the limiting portion and the limiting column is larger than that of the spiral spring when it is compressed to the utmost; when the limiting portion and the limiting column are pressed against each other, the nut is unable to lower down any further, and the nut turns and skids in the circumferential direction. At this point, the spiral spring is not fully compressed to the utmost, and thus the spiral spring is protected and prevented from being damaged.

DETAILED DESCRIPTION OF THE INVENTION

The structure and the technical means adopted by one embodiment of the present invention to achieve the above and other objects can be best understood by referring to the following detailed description of the preferred embodiments and the accompanying drawings. However, the present invention is not limited by the preferred embodiments.

Figure 1:
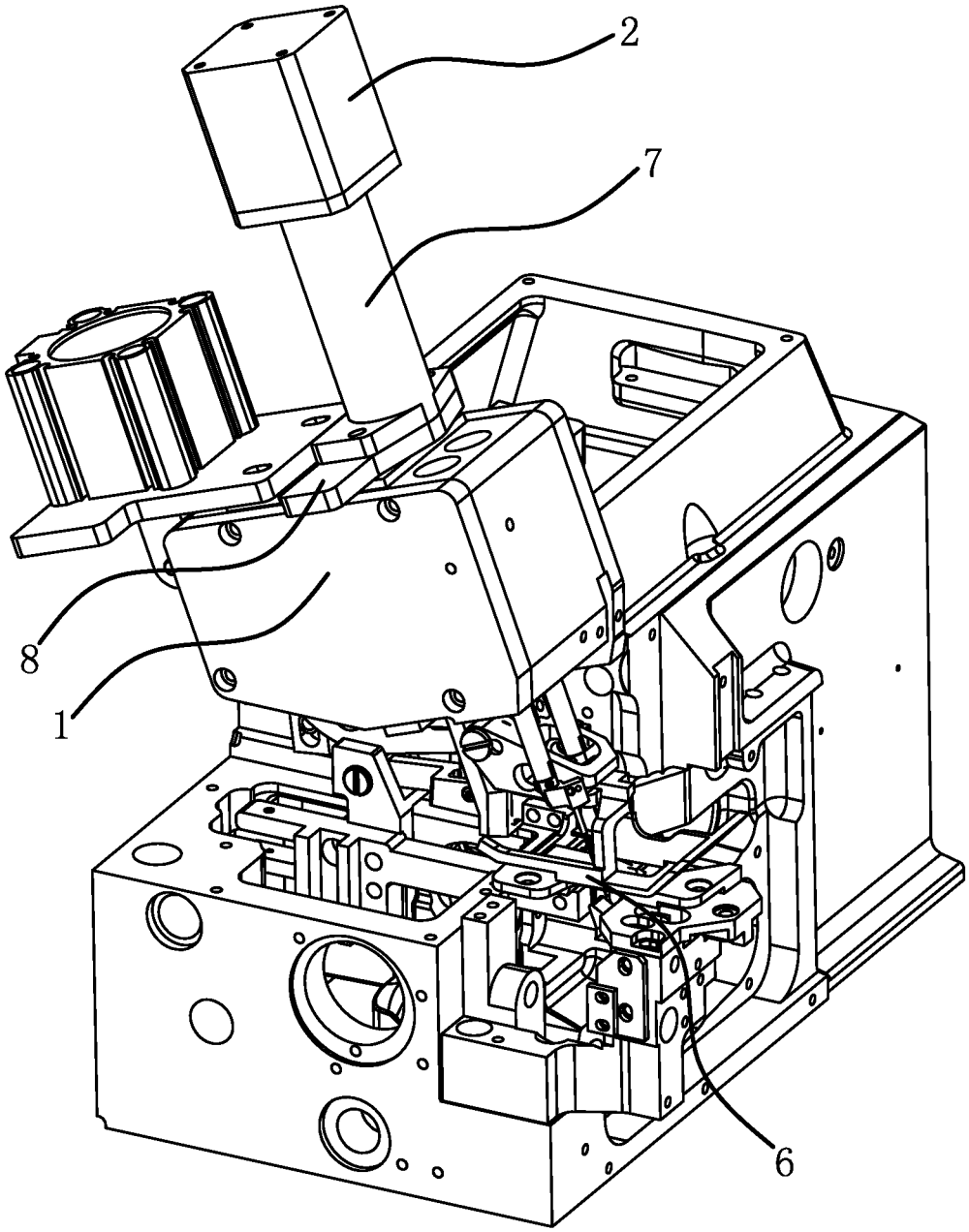
FIG. 1 is a perspective view of one embodiment of a sewing machine.
Figure 2:
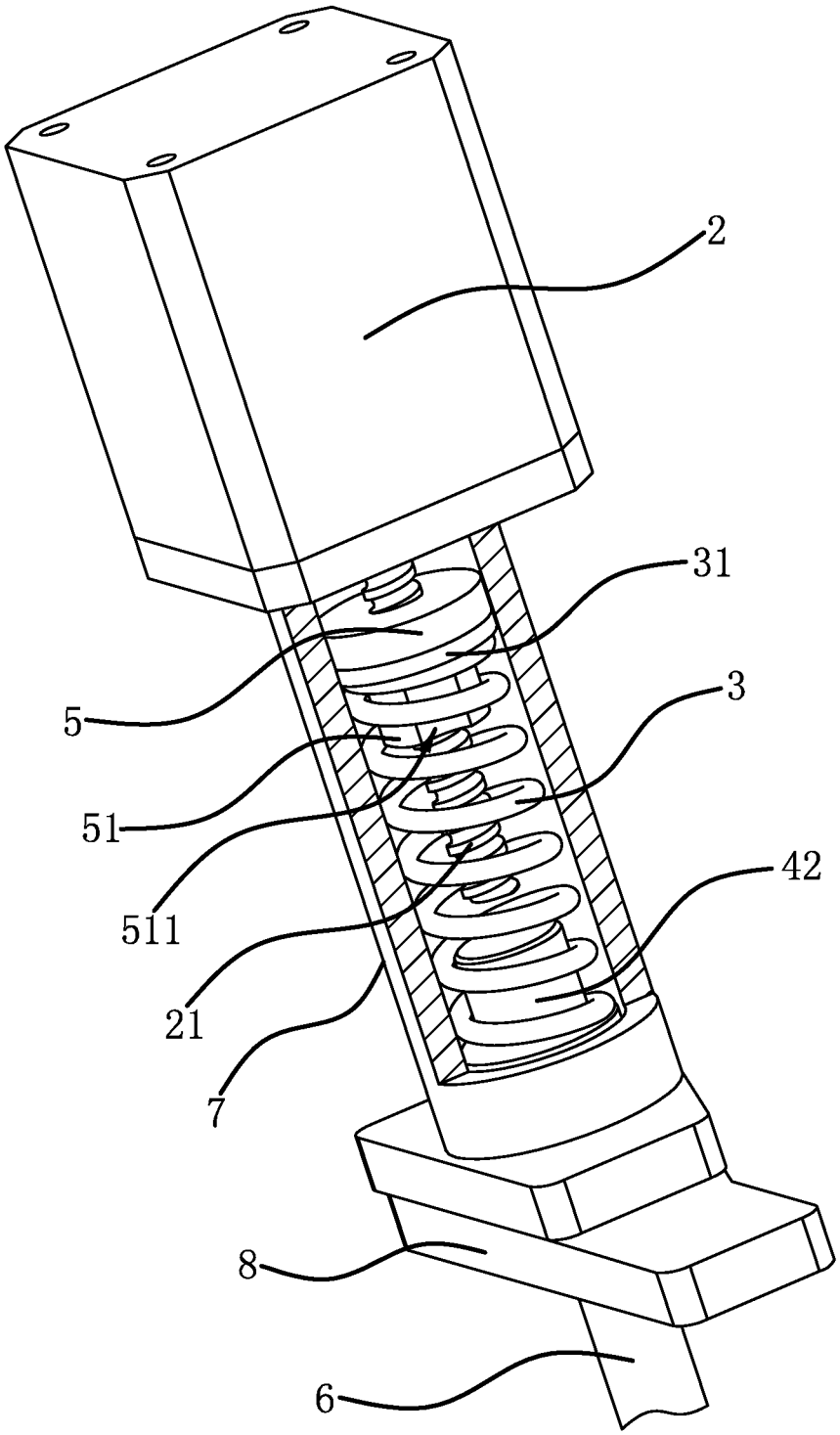
FIG. 2 is a schematic view of a partially sectioned sleeve in one embodiment of a pressure adjustment mechanism.
Figure 3:
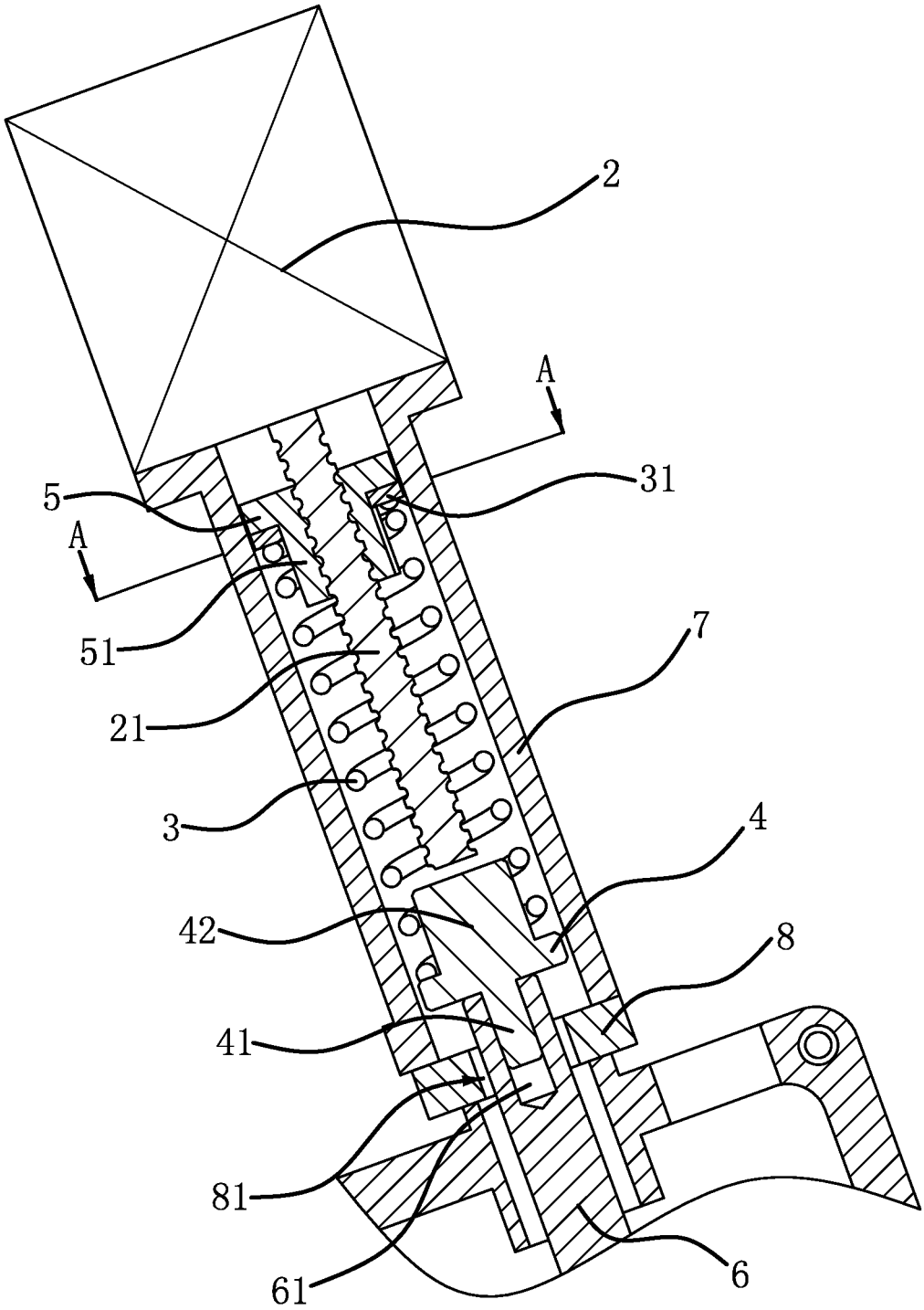
FIG. 3 is sectional view of one embodiment of a pressure adjustment mechanism.

One embodiment of a pressure adjustment mechanism of a sewing machine presser foot as shown in FIG. 1, the sewing machine comprises a frame 1, and the pressure adjustment mechanism comprises a motor 2, a sleeve 7 and a cover plate 8. The motor 2 is fixed on an upper end of the sleeve 7, a lower end of the sleeve 7 is fixed on the cover plate 8, and the cover plate 8 is fixed on the frame 1. At this point, the sleeve 7 is inclined; in other words, the axial direction of the sleeve 7 and the vertical direction form an included angle between 15° and 25°. As shown in FIGS. 2 and 3, the pressure adjustment mechanism further comprises a screw 21, a spiral spring 3 and a pressing plate 4. The spiral spring 3 and the pressing plate 4 are disposed inside the sleeve 7. A gap is disposed between an inner circumferential wall of the sleeve 7, and a pad 31 and the pressing plate 4. The screw 21 is formed by processing an outer thread on an outer circumferential wall of a shaft of the motor 2. A nut 5 is screwed and connected on the screw 21, and the nut 5 is lifted or lowered by the screw 21. The nut 5 is disposed inside the sleeve 7. A gap is also disposed between the nut 5 and the inner circumferential wall of the sleeve 7. The pressing plate 4 is underneath the nut 5. The circumferential direction of the nut 5 is unfixed. The spiral spring 3 is located between the nut 5 and the pressing plate 4. An upper end of the spiral spring 3 is fixedly connected with the metal pad 31. A center hole 311 is disposed on the pad 31. The screw 21 goes through the center hole 311 of the pad 31. An upper side of the pad 31 is pressed against a lower side of the nut 5. A lower end of the spiral spring 3 is pressed against an upper side of the pressing plate 4, and, in the circumferential direction, the lower end of the spiral spring 3 and the pressing plate 4 are unfixed. A presser foot 6 has a rod-shaped upper end. A through hole 81 is disposed on the cover plate 8, and the pressing plate 4 and the through hole 81 are oppositely disposed. The upper end of the presser foot 6 goes through the through hole 81 and presses against the pressing plate 4. In the circumferential direction, the pressing plate 4 and the upper end of the presser foot 6 are unfixed. The spiral spring 3 is being compressed under the effects of the nut 5 and the pressing plate 4.

Figure 4:
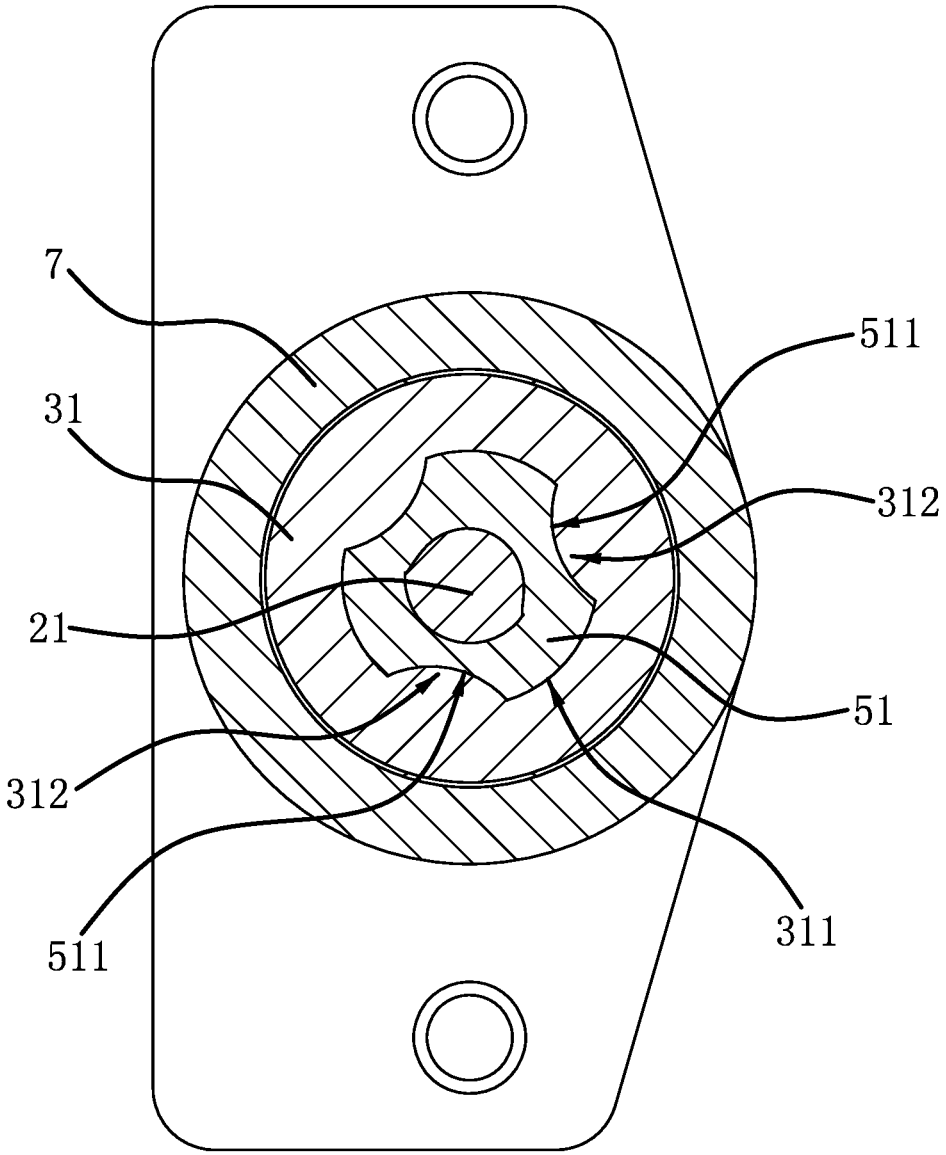
FIG. 4 is a sectional view of FIG. 3 along line A-A.

Specifically, a lower side of one embodiment of the pressing plate 4 has an inserting column 41. The upper end of the presser foot 6 has an inserting hole 61. The inserting column 41 is insertedly connected inside the inserting hole 61. The presser foot 6 keeps the pressing plate 4 stable through the inserting column 41. The upper side of the pressing plate 4 has a limiting column 42, and the lower end of the spiral spring 3 is sleeved around the limiting column 42. The pressing plate 4 keeps the lower end of the unfixed spiral spring 3 stable through the limiting column 42. The nut 5 is made of plastic. The lower side of the nut 5 has a columnar limiting portion 51. A screw hole of the nut 5 penetrates to a lower end face of the limiting portion 51. The limiting portion 51 is inserted inside the center hole 311 of the pad 31. As shown in FIG. 4, three limiting protruded portions 312 are disposed on a hole wall of the center hole 311, and the limiting protruded portions 312 are protruded arcuately. Three axially disposed limiting grooves 511 are disposed on an outer wall of the limiting portion 51. Adaptively, the cross section of the limiting grooves 511 is also in an arc shape. The three limiting protruded portions 312 are engagedly connected in the three limiting grooves 511 respectively. Therefore, the limiting portion 51 and the pad 31 are fixed in the circumferential direction through the mating of the limiting protruded portions 312 and the limiting grooves 511. Wherein, the sum of the lengths of the limiting portion 51 and the limiting column 42 is larger than that of the spiral spring 3 when it is compressed to the utmost. Thereby, the spiral spring 3 is prevented from being fully compressed to the utmost which will result in damage.

When one embodiment of the pressure adjustment mechanism is in use, the spiral spring 3 is compressed between the nut 5 and the pressing plate 4. The pressing plate 4 generates a downward pressure against the presser foot 6. Thereby, between the upper end of the spiral spring 3 and the nut 5, between the lower end of the spiral spring 3 and the pressing plate 4, and between the pressing plate 4 and the presser foot 6, there is pressure. When the motor 2 actuates the screw 21 to turn, the nut 5 under the effect of the spiral spring 3 is subject to static friction in the circumferential direction. The static friction in the circumferential direction can limit the circumferential direction of the nut 5 and prevent the nut 5 from turning together with the screw 21. Thereby, the nut 5 is lifted up or lowered down in order to adjust the pressure of the presser foot 6. When the nut 5 is lowered overly, and if the limiting portion 51 and the limiting column 42 are pressed against each other causing the nut 5 not being able to lower down any further, because, in the circumferential direction, the nut 5 is unfixed, the nut 5 actuates the spiral spring 3 to turn together relative to the pressing plate 4; or the nut 5 actuates both the spiral spring 3 and the pressing plate 4 to turn together relative to the presser foot 6. Thereby, the nut 5 is prevented from being unable to lower, getting the screw 21 stuck, and causing the motor 2 to be overloaded and damaged.

Note that the specifications relating to the above embodiments should be construed as exemplary rather than as limitative of the present invention, with many variations and modifications being readily attainable by a person of average skill in the art without departing from the spirit or scope thereof as defined by the appended claims and their legal equivalents.

Moreover, the following technical terms mentioned in the present invention, for instances, the frame 1, the motor 2, the screw 21, etc., are used to explain and help to comprehend the present invention, but not as limitations thereof. Other technical terms may be used. Construing the technical terms as additional limitations is contrary to the scope and the spirit of the invention.

LIST OF REFERENCE PARTS

1 frame
2 motor
21 screw
3 spiral spring
31 pad
311 center hole
312 limiting protruded portions
4 pressing plate
41 inserting column
42 limiting column
5 nut
51 limiting portion
511 limiting groove
6 presser foot
61 inserting hole
7 sleeve
8 cover plate
81 through hole

What is claimed is:

1. A pressure adjustment mechanism for a presser foot of a sewing machine, comprising:

a motor;

a screw actuated by the motor;

a spiral spring;

a pressing plate capable of pressing against an upper end of the presser foot; and a nut being screwed and connected on the screw, the nut being lifted or lowered by the screw, and the pressing plate being underneath the nut;

wherein the nut is unfixed in a circumferential direction, the spiral spring is located between the nut and the pressing plate, an upper end of the spiral spring is pressed against the nut, a lower end of the spiral spring is pressed against the pressing plate, and the spiral spring is being compressed under effects of the nut and the pressing plate;

wherein the upper end of the spiral spring is fixedly connected to a metal pad, a center hole is disposed on the pad, the screw goes through the center hole of the pad, a lower side of the nut has a columnar limiting portion, the limiting portion is inserted into the center hole of the pad, and a limiting structure is disposed between the limiting portion and the pad, the limiting structure is capable of preventing the nut from turning in the circumferential direction relative to the pad.

2. The pressure adjustment mechanism of the sewing machine presser foot as claimed in claim 1 wherein the lower end of the spiral spring is pressed against an upper side of the pressing plate, and, the lower end of the spiral spring and the pressing plate are unfixed in the circumferential direction.

3. The pressure adjustment mechanism of the sewing machine presser foot as claimed in claim 2 wherein a lower side of the pressing plate has an inserting column for sleevely connecting with the upper end of the presser foot, the upper side of the pressing plate has a limiting column, and the lower end of the spiral spring is sleeved around the limiting column.

4. The pressure adjustment mechanism of the sewing machine presser foot as claimed in claim 2 wherein an upper side of the pad is pressed against the lower side of the nut.

5. The pressure adjustment mechanism of the sewing machine presser foot as claimed in claim 4 wherein the nut is made of plastic.

6. The pressure adjustment mechanism of the sewing machine presser foot as claimed in claim 5 wherein the limiting structure comprises a plurality of limiting protruded portions disposing on a hole wall of the center hole, a plurality of axially disposed limiting grooves is disposed on an outer wall of the limiting portion, and the limiting protruded portions are engagedly connected in the limiting grooves.

7. The pressure adjustment mechanism of the sewing machine presser foot as claimed in claim 5 wherein a sum of lengths of the limiting portion and the limiting column is larger than a length of the spiral spring when it is fully compressed.

8. The pressure adjustment mechanism of the sewing machine presser foot as claimed in claim 5 wherein a shaft outer wall of the motor has an outer thread to form the screw, and a screw hole of the nut penetrates to a lower end face of the limiting portion.

9. The pressure adjustment mechanism of the sewing machine presser foot as claimed in claim 1 wherein the pressure adjustment mechanism further comprises a sleeve; the nut, the spiral spring, and the pressing plate are disposed inside the sleeve; the motor is fixedly connected on an upper end of the sleeve; a lower end of the sleeve is fixedly connected with a cover plate, a through hole is disposed on the cover plate for the upper end of the presser foot to go through; and the pressing plate and the through hole are oppositely disposed.

10. The pressure adjustment mechanism of the sewing machine presser foot as claimed in claim 9 wherein a gap is disposed between an inner circumferential wall of the sleeve and the nut, the pad, and the pressing plate.

* * * * *